US008178478B2

(12) United States Patent
Lawrence et al.

(10) Patent No.: US 8,178,478 B2
(45) Date of Patent: May 15, 2012

(54) LUBRICATING OIL COMPOSITIONS

(75) Inventors: Brian Lawrence, Sutton Courtenay (GB); Christopher Locke, Wantage (GB)

(73) Assignee: Infineum International Limited (GB)

( * ) Notice: Subject to any disclaimer, the term of this patent is extended or adjusted under 35 U.S.C. 154(b) by 519 days.

(21) Appl. No.: 11/817,241

(22) PCT Filed: Feb. 23, 2006 (Under 37 CFR 1.47)

(86) PCT No.: PCT/EP2006/001826

§ 371 (c)(1), (2), (4) Date: Oct. 10, 2008

(87) PCT Pub. No.: WO2006/089799

PCT Pub. Date: Aug. 31, 2006

(65) Prior Publication Data

US 2009/0325834 A1 Dec. 31, 2009

(30) Foreign Application Priority Data

Feb. 28, 2005 (GB) ..... 0504070.4

(51) Int. Cl.
*C10M 137/10* (2006.01)
*C10M 131/00* (2006.01)

(52) U.S. Cl. ..... 508/371; 508/379; 508/502

(58) Field of Classification Search ..... 508/371, 508/379, 502
See application file for complete search history.

(56) References Cited

U.S. PATENT DOCUMENTS 5,164,101 A * 11/1992 Brownawell et al. ..... 508/172
5,569,405 A * 10/1996 Nakazato et al. ..... 508/192
5,744,430 A * 4/1998 Inoue et al. ..... 508/295
6,074,993 A 6/2000 Waddoups et al. ..... 508/364
6,348,438 B1 * 2/2002 Le Coent et al. ..... 508/332

FOREIGN PATENT DOCUMENTS

EP 1 013 749 A 6/2000

* cited by examiner

*Primary Examiner* — Walter D Griffin
*Assistant Examiner* — Francis C Campanell

(57) ABSTRACT

An internal combustion engine crankcase lubricating oil composition is disclosed. The crankcase lubricating oil composition has a TBN no greater than 6 and contains the following additives: (B1) a metal detergent system having a metal ratio no greater than 3, as the sole detergent system; (B2) an organic ashless friction modifier; (B3) an oil-soluble molybdenum friction modifier; and (B4) a metal dihydrocarbyl dithiophosphate.

14 Claims, 2 Drawing Sheets

LUBRICATING OIL COMPOSITIONS

Figure 1:
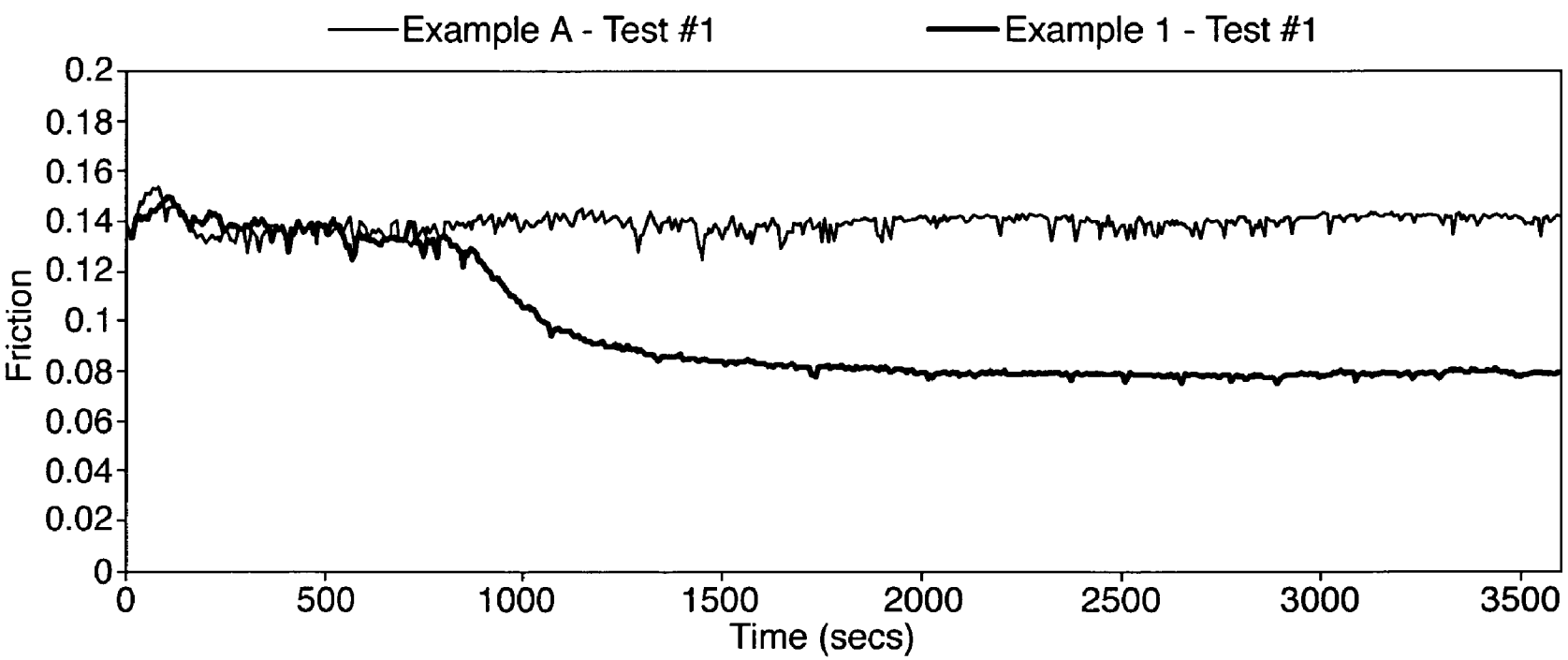

This invention relates to internal combustion engine crankcase lubricating oil compositions, in particular those with improved friction characteristics.

BACKGROUND OF THE INVENTION

Internal combustion engines are lubricated by circulating lubricating oil (or crankcase lubricant) from an oil sump generally situated below the crankshaft of the engine. To reduce the energy and fuel requirements of the engine, there is a need for 110 crankcase lubricants that reduce the overall friction of the engine.

U.S. Pat. No. 6,423,671 ('671) relates to lubricating compositions with improved frictional characteristics which translates into improved fuel economy when the compositions are used in internal combustion engines. In particular, '671 relates to lubricant compositions containing organomolybdenum compounds together with zinc salts, metal-containing detergents and ashless friction modifiers (referred to as surfactants). '671 states that molybdenum compounds can improve frictional characteristics but that their effect is not fully realised in the above particular compositions because of preferred absorption on moving surfaces of the non-molybdenum polar components. This competition for absorption of polar components results, for example, in a tendency for detergents to be absorbed more readily then molybdenum compounds.

'671 meets the above problem by using dispersants to form a first semi-package with the above-mentioned non-molybdenum polar components, the semi-package being made by mixing and heating the components, for example at about 90° C. for about 1-3 hours. The molybdenum component is provided in a second semi-package, and the first and second semi-packages added to an oil of lubricating viscosity.

A problem with the approach described in '671 in that it requires additional processing steps, particularly the preparation of the first semi-package. The present invention meets the problem of competition for absorption in a different way, namely by employing a detergent system of low metal ratio and a lubricating oil composition of low total base number (TBN). Surprisingly, considerably better coefficient of friction results are achieved, as evidenced by the data in this specification.

SUMMARY OF THE INVENTION

In a first aspect, this invention provides an internal combustion engine crankcase lubricating oil composition comprising or made by admixing:

(A) a crankcase base oil of lubricating viscosity, in a major amount; and (B) the following additives, in respective minor amounts:

(B1) a metal detergent system comprising one or more metal salts of one or more acidic organic compounds, which system has a metal ratio of no greater than 3, preferably no greater than 2, more preferably no greater than 1.5, and which system constitutes the only metal detergent system in the lubricating oil composition;

(B2) at least one organic ashless friction modifier;

(B3) at least one oil-soluble molybdenum compound; and (B4) at least one metal dihydrocarbyl dithiophosphate, such as zinc dihydrocarbyl dithiophosphate.

In a second aspect, the invention provides the use, in an internal combustion engine crankcase lubricating oil composition having a total base number of no greater than 6, to enhance the friction characteristics of the composition, of a metal detergent system (B1), as defined in the first aspect of the invention, in combination with additives (B2), (3) and (B4) as defined in the first aspect of the invention.

Without wishing to be bound by any theory, it is believed that, in operation of the compositions in an engine, the following takes place. The metal dihydrocarbyl dithiophosphate (B4), an anti-wear additive, decomposes to form a phosphate 'glass' film on, for example, up to half of the relevant moving surface, principally on the asperities (or 'high spots'). (As is known, detergent can react with the metal phosphate to inhibit its decomposition and reduce its effectiveness). The organic friction modifier (B2) occupies the rest of the surface, and the molybdenum compound (B3) decomposes to molybdenum disulphide which forms as platelets distributed in the phosphate 'glass' film.

The coefficient of friction of oils containing molybdenum is in general much lower than that of oils containing organic friction modifiers (see U.S. Pat. No. 6,723,685). But, as stated in '671, competition from other polar additives reduces the effectiveness of the molybdenum. Surprisingly, use of a detergent system with a low metal ratio mitigates the above-mentioned adverse effect and allows the molybdenum to cause a lower coefficient of friction than would otherwise be obtainable in the presence of an organic friction modifier.

In this specification, the following words and expressions, if and when used, shall have the meanings ascribed below:

"active ingredient" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896.

Furthermore in this specification:

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Crankcase Base Oil (A)

The base oil is the primary liquid constituent of the composition into which additives and possibly other oils are blended.

A base oil may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2 s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol), Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethyl hexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the refined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch-synthesised hydrocarbons made from synthesis gas containing hydrogen and carbon monoxide using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups 1 to V according to the API EOLCS 1509 definition.

The oil of lubricating viscosity is provided in a major amount, in combination with a minor amount of the additives (B) and, if necessary, one or more co-additives such as described hereinafter, constituting the composition. This preparation may be accomplished by adding the additive directly to the oil or by adding it in the form of a concentrate thereof to disperse or dissolve the additive. Additives may be added to the oil by any method known to those skilled in the art, either prior to, contemporaneously with, or subsequent to, addition of other additives. As stated, the composition of the invention has a TBN not exceeding 6. For example, it does not exceed 5 or 4, and may be in the range of 1 to 4, such as 1 to 3, such as 1 to 2.

The terms "oil-soluble" or "dispersable", or cognate terms, used herein do not necessarily indicate that the compounds or additives are soluble, dissolvable, miscible, or are capable or being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Metal Detergent System (B1)

Metal detergents are additives that reduce formation of piston deposits in engines and that may have acid-neutralising properties, and the term 'detergent' is used herein to define a material capable of providing either or both of these functions within the lubricating oil composition. They are based on metal "soaps", that is metal salts of acidic organic compounds, sometimes referred to as surfactants, and that generally comprise a polar head with a long hydrophobic tail.

The metal detergent system of this invention can comprise one or more metal detergents and has, as stated, a metal ratio of no greater than 3. 'Metal ratio' in this specification means the ratio of the total number of moles of metal in the system to the number of moles of metal associated with the anion of the acidic organic compound or surfactant. It is a term referred to, for example, in "Chemistry & Technology of Lubricants" edited by Mortier and Orszulik (1992), page 71.

The metal ratio can be calculated by a) measuring the total amount of metal in the system; and then b) determining the amount of metal associated with the organic anion.

Suitable methods for measuring the total metal content are well known in the art and include X-ray fluorescence and atomic absorption spectrometry: in this specification, total calcium content is determined by the standard test method according to ASTM D 4927-02.

Suitable methods for determining the amount of metal associated with the organic anion include potentiometric acid titration of the metal salt to determine the relative proportions of the different basic constituents (for example, metal carbonate and metal salt of acidic organic compound); hydrolysis of a known amount of metal salt and then the potentiometric base titration of the acidic organic compound to determine the equivalent moles of acidic organic compound; and determination of the non-organic anions, such as carbonate, by measuring the $CO_2$ content.

In the case of a metal sulfonate, ASTM D3712 may be used to determine the metal associated with the sulfonate.

Where a system comprises one or more metal detergents and one or more co-additives, then the metal salt(s) may be separated from the co-additives, for example, by using dialysis techniques and then the metal salt may be analysed as described above to determine the metal ratio. Background information on suitable dialysis techniques is given by Amos, R. and Albaugh, E. W. in "Chromatography in Petroleum Analysis" Altgelt, K. H. and Gouw, T. H., Eds., pages 417 to 421, Marcel Dekker Inc., New York and Basel, 1979.

The metal detergent system, because of its low metal ratio, has a low proportion of base and may embrace systems having a low TBN, e.g. from 0 to 80 as measured by ASTM D-2896, such as those referred to in the art as "neutral".

The term 'neutral' as used herein refers to metal detergents that are stoichiometric or predominantly neutral in character, that is most of the metal is associated with an organic anion. For a metal compound to be completely neutral, the total number of moles of the metal cation to the total number of moles of organic anion associated with the metal will be stoichiometric.

The metal detergents of the present invention include predominantly neutral salts where minor amounts of non-organic anions, for example carbonate and/or hydroxide anions, may also be present provided their presence does not alter the predominantly neutral character of the metal salt.

The metal ratio of the system may be no greater than 2, for example no greater than 1.5, such as no greater than 1.4 or no greater than 1.35. Preferably, it is at least 1.

The metal detergent system may include one or more metal detergents; it may include a metal detergent in a mixture of metal detergents, whose individual metal ratio falls outside of the metal ratio range of this invention. Such a mixture is within the scope of this invention provided the overall metal ratio of the mixture falls within the metal ratio range of this invention.

As examples of metal, there may be mentioned alkali metals such as lithium, sodium, potassium, and alkaline earth metals such as calcium and magnesium, including mixtures thereof. Calcium is preferred and, when used, preferably constitutes 0.05 or less, preferably 0.02 to 0.05, mass % of the composition, measured as atoms of calcium.

Acidic organic compounds include organic acids. As examples of acidic organic compounds there may be mentioned salicylic acids sulfonic acids, phenols, sufurised phenols, phosphonic acids, naphthenic acids and aliphatic and aromatic carboxylic acids. Oil-solubility of metal salts of the acidic organic compounds may be conferred by presence of hydrocarbyl substituents.

Calcium salicylate is preferred in the metal detergent system of this invention.

The metal detergents may be salts of one type of surfactant or salts of more than one type of surfactant. Preferably, they are salts of one type of surfactant.

Organic Ashless Friction Modifiers (B2)

Organic, ashless (metal-free), nitrogen-free organic friction modifiers are useful in the lubricating oil compositions of the present invention and are known generally and include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988) Vol. 1, pp. 3-26.

Preferred organic ashless nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and diamines, which improve boundary layer lubrication, but may contribute to the deterioration over time of fluoroelastomer seal materials. One common class of such metal free, nitrogen-containing friction modifier comprises ethoxylated amines. They may be in the form of an adduct or reaction product with a boron compound such as a boric oxide, boron halide, metaborate, boric acid or a mono-, di- or tri-alkyl borate.

Typically, the organic ashless friction modifier is added in an amount of from 0.25 to 2.0 mass. % (AI), based on the total weight of the lubricating oil composition.

(B2) may comprise one or both of ester-based and amine-based organic ashless friction modifiers.

Oil-soluble Molybdenum Compound (B3)

For the lubricating oil compositions of this invention, any suitable oil-soluble organo-molybdenum compound having friction modifying properties in lubricating oil compositions may be employed. As examples of such oil-soluble organo-molybdenum compounds, there may be mentioned dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

The molybdenum compound may be mono-, di-, tri- or tetra-nuclear. Dinuclear and trinuclear molybdenum compounds are preferred. The molybdenum compound is preferably an organo-molybdenum compound. More preferably, the molybdenum compound is selected from the group consisting of molybdenum dithiocarbamates (MoDTC), molybdenum dithiophosphates, molybdenum dithiophosphinates, molybdenum xanthates, molybdenum thioxanthates, molybdenum sulfides and mixtures thereof. Most preferably, the molybdenum compound is present as a molybdenum dithiocarbamate or a trinuclear organo-molybdenum compound.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Among the molybdenum compounds useful in the compositions of this invention are organo-molybdenum compounds of the formulae $Mo(ROCS_2)_4$ and $Mo(RSCS_2)_4$, wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

One class of preferred organo-molybdenum compounds useful in the lubricating compositions of this invention are trinuclear molybdenum compounds, especially those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of:

1 —X—R,

2

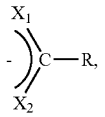

3

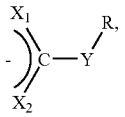

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g. halo, especially chloro and fluoro, amino, alkoxyl, mercapto, alkylmercapto, nitro, nitroso, sulfoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ to have cationic cores surrounded by anionic ligands and are represented by structures such as

6

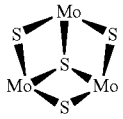

and

7

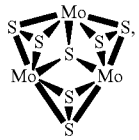

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligands' organo groups. Preferably, the ligand source chosen has a sufficient number of carbon atoms in its organo groups to render the compound soluble or dispersible in the lubricating composition.

The lubricating oil compositions of the present invention may contain the molybdenum compound in an amount providing the composition with at least 10 ppm, preferably from 10 to 350, more preferably from 30 to 200, still more preferably from 50 to 100, ppm by mass of molybdenum, based on atoms of molybdenum, in the total mass of the lubricating oil composition.

Metal Dihydrocarbyl Dithiophosphate (B4)

Metal dihydrocarbyl dithiophosphate that may be used may comprise dihydrocarbyl dithiophosphate metal salts wherein the metal may be an alkali or alkaline earth metal, or aluminum, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

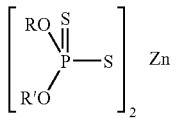

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

To limit the amount of phosphorus introduced into the lubricating oil composition by ZDDP to no more than 0.1 mass % (1000 ppm), the ZDDP should preferably be added to the lubricating oil compositions in amounts no greater than from about 1.1 to 1.3 mass %, based upon the total mass of the lubricating oil composition.

Other Additives

Other additives, such as the following, may also be present in lubricating oil compositions of the present invention.

Ashless dispersants comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorus esters, metal thiocarbamates and oil soluble copper compounds as described in U.S. Pat. No. 4,867,890.

Rust inhibitors selected from the group consisting of nonionic polyoxyalkylene polyols and esters thereof; polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise know as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20, preferably 4 to 18, and most preferably 5 to 17, mass % of the concentrate or additive package with the remainder being base stock.

Engines

The invention is applicable to a range of internal combustion engines such as compression-ignited and spark-ignited two- or four-stroke reciprocating engines. Examples include engines for power-generation, locomotive and marine equipment and heavy duty on-highway trucks; heavy duty off-highway engines such as may be used for agriculture construction and mining and engines for light duty commercial and passenger car applications.

Base (B5)

The composition of the invention may, if desired, include a base ("first base") that is capable of neutralising fuel combustion acids that are generated in use to form, in solution in the composition, a salt or salts of the first base and the acids, which first base is displaceable from the salt or salts by a stronger base (4"second base").

When a first base is included in the composition, the composition may conveniently constitute part of an internal combustion engine lubricating system that includes the second base immobilised therein. In operation, the second base displaces at least part of the first base from the salt or salts to form and retain a salt or salts of the second base and the acid or acids so that first base thereby displaced enters the composition.

Such a system is described in U.S. Pat. No. 5,164,101 ('101) which describes examples of first bases (referred to as weak bases) such as dialkyl amines, trialkyl amines, dialkyl phosphines, trialkyl phosphines, polybutenyl succinimides of polyamines where the polybutenyl group has a number average molecular weight of 900 to 5,000, and heterocyclics.

The first base must be strong enough to neutralize the combustion acids (i.e. form a salt). Suitable first bases will typically have a pKa from 4 to 12.

The first base should be sufficiently soluble for the salt or salts formed to remain soluble in the lubricant and not to precipitate.

The amount of first base in the lubricant will vary depending upon the amount of combustion acids present, the degree of neutralization desired, and the specific applications of the lubricant. In general, the amount need only be that which is effective or sufficient to neutralize at least a portion of the combustion acids.

Typically, the amount will range from 0.01 to 3 or more, preferably from 0.1 to 1.0, mass %.

Following neutralization of the combustion acids, the neutral salts thereby formed are passed or circulated from the piston ring zone with the lubricant and contacted with the second base. The second base is a base that will displace the first base, at least partly, from the neutral salts and return the first base to the lubricant for recirculation to the piston ring zone where the first base is reused to neutralize combustion acids. Examples of suitable second bases (referred to as strong bases in '101) include, but are not limited to, barium oxide, calcium carbonate, calcium oxide, calcium hydroxide, magnesium carbonate, magnesium hydroxide, magnesium oxide, sodium aluminate, sodium carbonate, sodium hydroxide, zinc oxide, or their mixtures; magnesium oxide is particularly preferred.

The second base may be adhered to or incorporated (e.g. impregnated) on or with a substrate immobilized in the lubricating system of the engine. The substrate can be located on the engine block or near the sump. Preferably, the substrate, if used, will be part of the filter system for filtering lubricant, although it could be separate therefrom. Preferred substrates include paper, fabric, felt, glass, plastic, microglass and both woven and non-woven polymeric fibre. Other useful substrates include, but are not limited to, alumina, activated clay, cellulose, cement binder, silica-alumina, and activated carbon. The substrate may be inert or not inert.

The second base may be incorporated into or adhered onto the substrate by methods known to those skilled in the art. For example, if the substrate is alumina, the second base can be deposited by using the following technique. A highly porous alumina is selected. The porosity of the alumina is determined by weighing dried alumina and then immersing it in water. The alumina is removed from the water and the surface water removed by blowing with dry air. The alumina is then reweighed and compared with the dry alumina weight. The difference in weight is expressed as grams of water per gram of dry alumina. A saturated solution of calcium oxide in water is prepared. This solution is then added to the dry alumina in an amount equal to the difference between the weight of the wet and dry alumina. The water is removed from the alumina with heat leaving calcium oxide deposited on the alumina as the product. This preparation can be carried out under ambient conditions, except that the water removal step is performed at about 100° C.

The amount of second base required will vary with the amount of first base in the lubricant and the amount of combustion acids formed during engine operation. However, since the second base is not being continuously regenerated for reuse (unlike the first base) the amount of second base must be at least equal to (and preferably be a multiple of) the equivalent weight of the first base in the lubricant. Therefore, the amount of second base should be from 1 to 15 times, preferably from about 1 to 5 times, the equivalent weight of the first base in the lubricant.

Once the first base has been displaced from the soluble neutral salts, the second base: combustion acid salts thus formed will be immobilized as deposits with the second base, for example on the substrate, if used. Thus, deposits which would normally be formed in the piston ring zone are not formed until the soluble salts contact the second base. Preferably, the second base will be located such that it can be easily removed from the lubricating system, e.g. by including it as part of the oil filter system.

Embodiments

As preferred embodiments of the invention, internal combustion engine crankcase lubricating oil compositions (identified below by lower case letters) having a total base number in the range of 1 to 3 and comprising or being made by admixing the following additives may be mentioned:

a. (B1) a metal detergent system comprising a calcium salicylate detergent, the system having a metal ratio of from 1 to 2 and being the only metal detergent system in the composition;
   (B2) an organic friction modifier in the form of an ester of glycerol and of a carboxylic acid containing 12 to 30 carbon atoms and 0 to 3 carbon-to-carbon double bands;
   (B3) an oil-soluble molybdenum compound in the form of a tri-nuclear organo-molybdenum compound; and
   (B4) a zinc dihydrocarbyl dithiophosphate.

b. (B1) a metal detergent system comprising a calcium salicylate detergent, the system having a metal ratio of from 1 to 2 and being the only metal detergent system in the composition;
   (B2) an organic friction modifier in the form of an ester of glycerol and of a carboxylic acid containing 12 to 30 carbon atoms and 0 to 3 carbon-to-carbon double bands,
   (B3) an oil-soluble molybdenum compound in the form of a di-nuclear oregano-molybdenum compound; and
   (B4) a zinc dihydrocarbyl dithiophosphate.

c. (B1) a metal detergent system comprising a calcium salicylate detergent, the system having a metal ratio of from 1 to 2 and being the only metal detergent system in the composition;
   (B2) an organic friction modifier in the form of an ester of glycerol and of a carboxylic acid containing 12 to 30 carbon atoms and 0 to 3 carbon-to-carbon double bands;
   (B3) an oil-soluble molybdenum compound in the form of a di-nuclear or tri-nuclear organo-molybdenum compound providing the composition with from 10 to 350 ppm by mass of molybdenum, based on atoms of molybdenum in the total mass of the composition; and
   (B4) a zinc dihydrocarbyl dithiophosphate.

d. (B1) a metal detergent system comprising a calcium salicylate detergent, the system having a metal ratio of from 1 to 2 and being the only metal detergent system in the composition;
   (B2) an organic friction modifier in the form of a glycerol mono-oleate;
   (B3) an oil-soluble molybdenum compound in the form of a di-nuclear or tri-nuclear organo-molybdenum compound; and
   (B4) a zinc dihydrocarbyl dithiophosphate.

e. (B1) a metal detergent system comprising a calcium salicylate detergent, the system having a metal ratio of from 1 to 2 and being the only metal detergent system in the composition;
   (B2) an organic friction modifier in the form of an ester of glycerol and of a carboxylic acid containing 12 to 30 carbon atoms and 0 to 3 carbon-to-carbon double bands;
   (B3) an oil-soluble molybdenum compound in the form of a tri-nuclear organo-molybdenum compound; and
   (B4) a zinc dihydrocarbyl dithiophosphate; and
   (B5) a first base, comprising a polybutenyl succinimide of polyamines where the polybutenyl group has a number average molecular weight of 900 to 5,000, capable of neutralising fuel combustion acids in the composition to form, in solutions in the composition, a salt or salts of the first base and the acids, which first base is displaceable from the salt or salts, at least in part, by a second base comprising magnesium oxide.

f. (B1) a metal detergent system comprising a calcium salicylate detergent, the system having a metal ratio of from 1 to 2 and being the only metal detergent system in the composition;
   (B2) an organic friction modifier in the form of an ester of glycerol and of a carboxylic acid containing 12 to 30 carbon atoms and 0 to 3 carbon-to-carbon double bands;
   (B3) an oil-soluble molybdenum compound in the form of a tri-nuclear organo-molybdenum compound; and
   (B4) a zinc dihydrocarbyl dithiophosphate; and
   (B5) a first base, comprising a polybutenyl succinimide of polyamines where the polybutenyl group has a number average molecular weight of 900 to 5,000, capable of neutralising fuel combustion acids in the composition to form, in solutions in the composition, a salt or salts of the first base and the acids, which first base is displaceable from the salt or salts, at least in part, by a second base comprising magnesium oxide, the composition being part of a lubricating system in which the second base is immobilised and is capable of displacing the first base from the salt or salts, at least in part, to form and retain a salt or salts of the second base and the acid or acids so that first base thereby displaced enters the composition.

EXAMPLES

The invention will now be described in the following examples which are not intended to limit the scope of the claims hereof.

Figure 2:
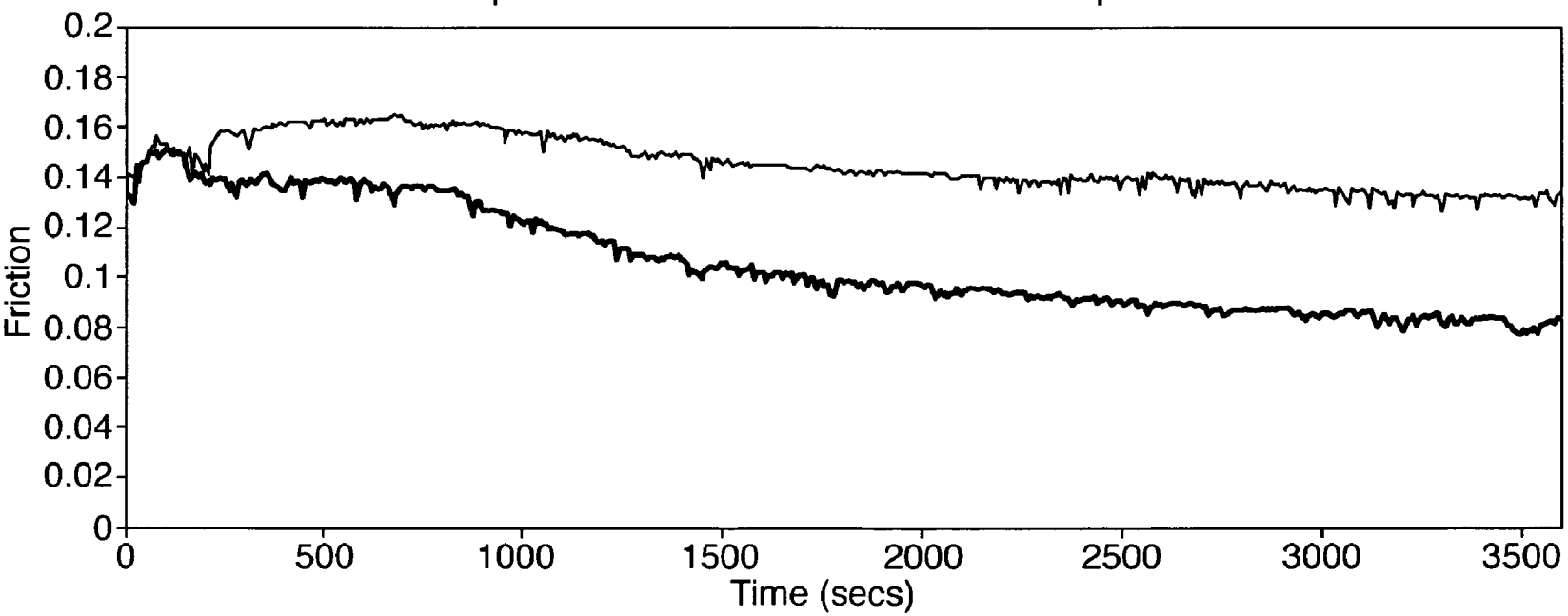

In the examples, reference will be made to the accompanying drawings in which:

FIG. 1 depicts results of a first test (Test #1), in which the coefficient of friction of a lubricating oil composition of this invention and of a reference lubricating oil composition are measured as a function of time; and FIG. 2 depicts results of a second test (Test #2), in which the coefficient of friction of a lubricating oil composition of this invention and of a reference lubricating oil composition are measured as a function of time.

Lubricating Oil Compositions

Two crankcase lubricating oil compositions were blended. Each contained the same base oil and the same amount of the same following additives: a succinimide dispersant; a zinc dihydrocarbyl dithiophosphate (ZDDP) anti-wear additive; a glycerol mono-oleate (GMO) function modifier; a trinuclear molybdenum dithiocarbamate friction modifier; anti-oxidant system; and an antifoamant. Each composition contained, as the sole detergent system, a calcium salicylate detergent system but having different metal ratios and in different amounts. The properties of the two compositions are summarised below where Example 1 is an example of the invention and Example A is a reference example for comparison purposes and contains significant overbased calcium salicylate detergent as indicated in the properties below:

| | Example 1 | Example A |
|---|---|---|
| Metal Ratio (detergent system) | 1.4 | 5.89 |
| Salicylate (m/mols) | 4.73 | 9.48 |
| TBN (D2896) | 1.92 | 7.05 |
| Sulfated Ash | 0.25 | 0.80 |

-continued

| | Example 1 | Example A |
|---|---|---|
| Ca (mass %) | 0.025 | 0.22 |
| Mo (ppm) | 150 | 170 |
| P (mass %) | 0.05 | 0.052 |
| Zn (mass %) | 0.054 | 0.057 |
| GMO (mass %) | 0.20 | 0.20 |

Testing and Results

A high frequency reciprocating rig (HFRR) was used to evaluate the friction characteristics of the compositions (Examples 1 and A). The test protocol employed was as follows:

| | |
|---|---|
| Test Duration (mins) | 60 |
| Data Logging Interval (sec) | 5 |
| Test Load (g) | 400 |
| Frequency (Hz) | 20 |
| Stroke Length (microns) | 1,000 |
| Temperature (C.) | 70 |

Two separate sets of tests, referred to as Test #1 and Test #2 respectively, were carried out. Results are expressed as coefficient of friction as a function of time and are depicted in FIG. 1 and FIG. 2.

Referring to FIG. 1 which depicts the results of Test #1, it is seen that, for approaching the first 1,000 seconds of the test, the coefficient of friction is around 0.14 for each of Examples 1 and A. Thereafter, the coefficient of friction of Example 1 drops to about 0.08 where it remains for the rest of the test. In contrast, Example A remains at about 0.14 for the duration of the test, i.e. it never drops in contrast with FIG. 1.

Referring to FIG. 2 which depicts the results of Test #2, the same general pattern as demonstrated in FIG. 1 is repeated, i.e. the coefficient of friction values for Example 1 and A are similar during the early part of the test, but thereafter Example 1 exhibits a significant reduction in coefficient of friction whereas Example A does not.

Without wishing to be bound by any theory, it is believed that, in the tests carried out, the molybdenum additive in Example 1 has become fully effective to lower the coefficient of friction after a short induction period, whereas, in Example A, the induction period is never passed because the overbasing present in Example A appears to inhibit film build-up and/or activity of the molybdenum additive.

The results are even more surprising because Example A contains more salicylate than Example 1, salicylate being considered to enhance friction performance, i.e. to lower coefficient of friction.

What is claimed is:

1. An internal combustion engine crankcase lubricating oil composition comprising:

(A) a crankcase base oil of lubricating viscosity, in a major amount; and (B) the following additives, in respective minor amounts:

(B1) a metal detergent system comprising one or more metal salts of one or more acidic organic compounds, which system has a metal ratio of no greater than 3, and which system constitutes the only metal detergent system in the lubricating oil composition;

(B2) at least one organic ashless friction modifier;

(B3) at least one oil-soluble molybdenum compound; and (B4) at least one metal dihydrocarbyl dithiophosphate, wherein the crankcase lubricating oil composition has a total base number, as measured according to ASTM D-2896, of no greater than 6.

2. A composition as claimed in claim 1 wherein the metal in (B1) is an alkaline earth metal.

3. A composition as claimed in claim 2 wherein (B1) consists of one or more calcium salicylates.

4. A composition as claimed in claim 1 wherein (B2) is an ester-based or amine-based aliphatic friction modifier or both.

5. A composition as claimed in claim 1 wherein (B3) is an organo-molybdenum compound.

6. A composition as claimed in claim 1 further comprising:

(B5) a first base capable of neutralizing fuel combustion acids in the composition to form, in solution in the composition, a salt or salts of the first base and the acids, which first base is displaceable from the salt or salts, at least in part, by a second base.

7. A composition as claimed in claim 6 as part of an internal combustion engine lubricating system that includes a second base immobilised in the lubricating system and capable of displacing the first base from the salt or salts, at least in part, to form and retain a salt or salts of the second base and the acid or acids so that first base thereby displaced enters the composition.

8. A method for enhancing the friction characteristics of an internal combustion engine crankcase lubricating oil composition having a total base number of no greater than 6 comprising:

adding an internal combustion engine crankcase lubricating oil composition comprising:

(A) a crankcase base oil of lubricating viscosity, in a major amount; and (B) the following additives, in respective minor amounts:

(B1) a metal detergent system comprising one or more metal salts of one or more acidic organic compounds, which system has a metal ratio of no greater than 3, and which system constitutes the only metal detergent system in the lubricating oil composition;

(B2) at least one organic ashless friction modifier;

(B3) at least one oil-soluble molybdenum compound; and (B4) at least one metal dihydrocarbyl dithiophosphate to an internal combustion engine.

9. A composition as claimed in claim 1 wherein said metal detergent system has a metal ratio of no greater than 2.

10. A composition as claimed in claim 9 wherein said metal detergent system has a metal ratio of no greater than 1.5.

11. A composition as claimed in claim 1 wherein the organo-molybdenum compound is a molybdenum dialkyl dithiocarbamate compound.

12. A method as claimed in claim 8 wherein said metal detergent system has a metal ratio of no greater than 2.

13. A method as claimed in claim 12 wherein said metal detergent system has a metal ratio of no greater than 1.5.

14. A composition as claimed in claim 11 wherein the molybdenum dialkyl dithiocarbamate compound is a dinuclear or a trinuclear molybdenum dialkyl dithiocarbamate compound.

* * * * *

UNITED STATES PATENT AND TRADEMARK OFFICE

CERTIFICATE OF CORRECTION

PATENT NO. : 8,178,478 B2
APPLICATION NO. : 11/817241
DATED : May 15, 2012
INVENTOR(S) : Brian J. Lawrence et al.

It is certified that error appears in the above-identified patent and that said Letters Patent is hereby corrected as shown below:

On the Title page, line (75), delete "Christopher Locke, Wantage (GB)" and replace with --Roger W. Glyde, Oxfordshire (GB)--.

Signed and Sealed this
Second Day of October, 2012

David J. Kappos

David J. Kappos
*Director of the United States Patent and Trademark Office*